United States Patent [19]

Focke et al.

[11] Patent Number: 4,603,800

[45] Date of Patent: Aug. 5, 1986

[54] APPARATUS FOR TRANSPORTING SHEETS OF PACKAGING MATERIAL

[75] Inventors: Heinz Focke; Kurt Liedtke, both of Verden, Fed. Rep. of Germany

[73] Assignee: Focke & Co., (GmbH & Co.), Verden, Fed. Rep. of Germany

[21] Appl. No.: 711,871

[22] Filed: Mar. 14, 1985

[30] Foreign Application Priority Data

Mar. 22, 1984 [DE] Fed. Rep. of Germany ..... 3410470

[51] Int. Cl.[4] ..... B65H 20/34

[52] U.S. Cl. ..... 226/119; 226/189; 226/195; 242/47.5; 242/75.3; 242/154

[58] Field of Search ..... 226/189, 113, 114, 118, 226/119, 195; 242/58, 58.1, 55.01, 47.5, 75.3, 154

[56] References Cited

U.S. PATENT DOCUMENTS

| | | | |
|---|---|---|---|
| 1,014,980 | 1/1912 | Sykes | 242/154 |
| 1,261,056 | 4/1918 | Pfohl | 226/119 X |
| 2,171,741 | 9/1939 | Cohn et al. | 226/119 X |
| 3,278,100 | 10/1966 | Hornberger | 226/118 X |
| 3,503,859 | 3/1970 | Concarovs et al. | 226/113 X |
| 3,727,820 | 4/1973 | Braun | 226/118 X |
| 3,743,153 | 7/1973 | Moss | 226/113 X |
| 3,854,675 | 12/1974 | Hunke | 226/114 X |
| 3,865,296 | 2/1975 | Alverson | 226/113 X |
| 4,009,814 | 3/1977 | Singh | 226/113 |
| 4,223,822 | 9/1980 | Clitheroe | 226/118 |
| 4,325,519 | 4/1982 | McLean | 242/75.41 |

FOREIGN PATENT DOCUMENTS

| | | | |
|---|---|---|---|
| 217961 | 11/1961 | Austria . | |
| 616271 | 1/1949 | United Kingdom | 226/119 |
| 775552 | 5/1957 | United Kingdom | 226/119 |

*Primary Examiner*—Stanley N. Gilreath
*Attorney, Agent, or Firm*—Sughrue, Mion, Zinn, Macpeak & Seas

[57] ABSTRACT

To guarantee a permanent continuous delivery of sheets of material (12), packaging material, on packaging machines, sheet stocks (14) are formed, and these guarantee that the sheet of material 12 can be stopped temporarily in a region preceding them, without conveyance being interrupted in the region where it is conveyed further. During this time, the sheet of material (12) is drawn off from the sheet stock (14). A supply rocker (10) to form the sheet stock (14) is designed such that, in an initial position, the sheet of material (12) is free of deflections or loops.

6 Claims, 4 Drawing Figures

APPARATUS FOR TRANSPORTING SHEETS OF PACKAGING MATERIAL

DESCRIPTION

Figure 1:
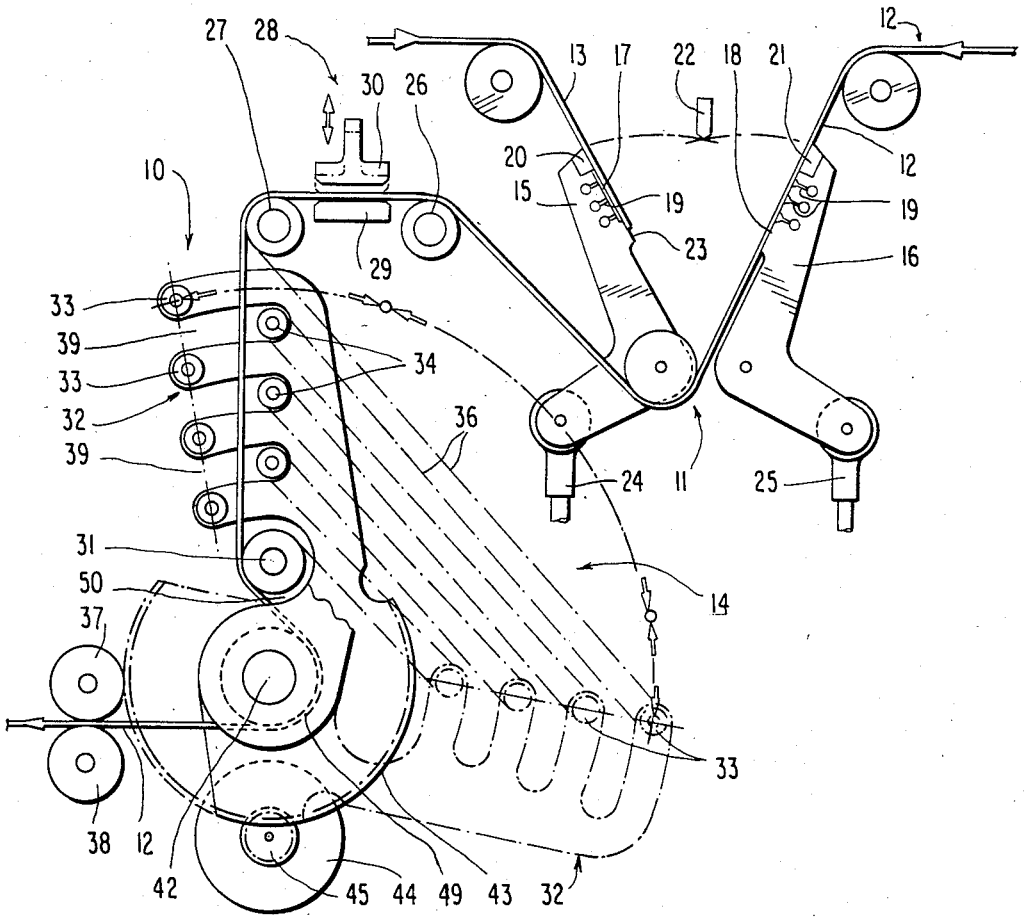

The invention relates to an apparatus for transporting sheets of material, especially packaging material, in conjunction with a packaging machine, the sheet of material (temporarily) forming a sheet stock (reserve) by being deflected in the form of a loop round looping rollers, moveable relative to one another, and counter rollers of a supply rocker.

Devices for forming sheet reserves by guiding the sheet of material in the form of a loop are known and customary in conjunction with packaging machines. The essential purpose of such sheet stocks is to compensate any standstills of the sheet of material in the region of preceding or succeeding equipment, in such a way that the sheet of material flows continuously during the operation as a whole. For this purpose, the sheet of material passes through a supply rocker which conventionally consists of a group of fixed counter rollers and a matching group of looping rollers. Differing sheet stocks are formed because of the variable distance between the groups of rollers. During operation, that is to say during the transport of the sheet of material, these sheet stocks can be varied as a result of a relative movement of the looping rollers in relation to the counter rollers.

The invention deals with the development of a supply rocker of this type, with the object of improving the run of the sheet of material whilst at the same time preserving a fully operational supply rocker of this type.

To achieve this object, the apparatus according to the invention is characterised in that the supply rocker and its looping rollers and counter rollers can be moved out of the deflected position, in such a way that the sheet of material (also) runs free of loops in the region of the supply rocker.

The supply rocker according to the invention is therefore distinguished by the fact that it can be cancelled completely as regards the formation of loops of the sheet of material. In this operating position, a group of looping rollers on the one hand and a group of counter rollers on the other hand are each located on different sides of the sheet of material, so that the latter can be guided unimpeded through the looping rollers and counter rollers (in a straight line). When a sheet stock is required for measures to be carried out, this is formed by means of an appropriate relative adjustment of the looping rollers, in such a way that larger or smaller loops of the sheet of material are formed between the looping rollers on the one hand and counter rollers on the other hand.

The looping rollers and/or counter rollers are arranged on specially designed holders which allow them to be displaced relative to one another in the way mentioned above, in particular with different positions of the looping rollers in relation to the sheet of material. According to a preferred embodiment, one looping-roller carrier is made comb-like, with projections each having a looping roller arranged at their end. In the stock-free position when the sheet of material runs in a straight line, the counter rollers penetrate into recesses formed between the comb-like projections of the looping-roller carrier.

The looping-roller carrier preferably consists of two jointly moved roller arms which are arranged at a distance from one another and which are connected to one another by means of the transversely directed looping rollers. The sheet of material runs in the region between the roller arms. These are mounted rotatably in a common central pivot bearing. This is equipped at the same time with a deflecting roller for the sheet of material.

The supply rocker can be provided with a multiple-armed, especially double-armed, pivoting arm, that is with two part arms which extend on both sides of the central pivot bearing and each of which carries a number of looping rollers. When the looping-roller carrier designed in this way is rotated, the part arms are pivoted simultaneously and moved into the loop-forming stock position or back into the initial position. This design is distinguished by a particularly small space requirement. The pivot bearing central part rotating with the looping-roller carrier (roller arm) is provided with a diagonal passage for the sheet of material, so that the latter runs through this central pivot bearing in any position of the supply rocker.

According to a further proposal of the invention, the looping-roller carrier can be moved in a non-circular path, in particular in a straight line, because of being mounted on appropriate guide rods and being driven, for example, by means of a pinion and rack. In this embodiment, the counter roller carrier is appropriately made comb-like, and in the stock-free position the looping rollers penetrate into recesses in the counter roller carrier.

A clamp for temporarily stopping the sheet of material is preferably located in front of the supply rocker designed thus in the direction of transport of the sheet of material. Furthermore, deflecting rollers for the sheet of material are arranged respectively on both sides of the supply rocker or above and below it.

Figure 2:
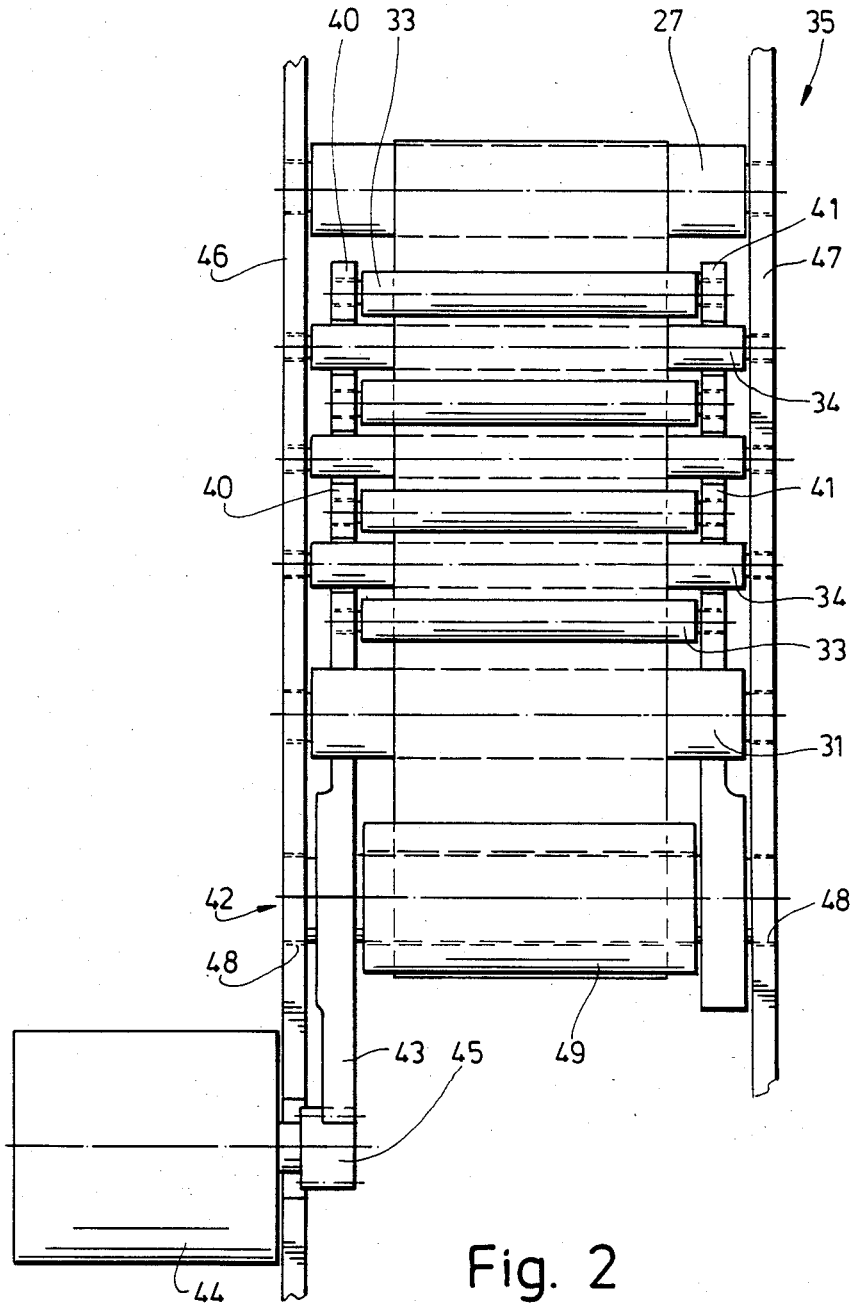
Figure 3:
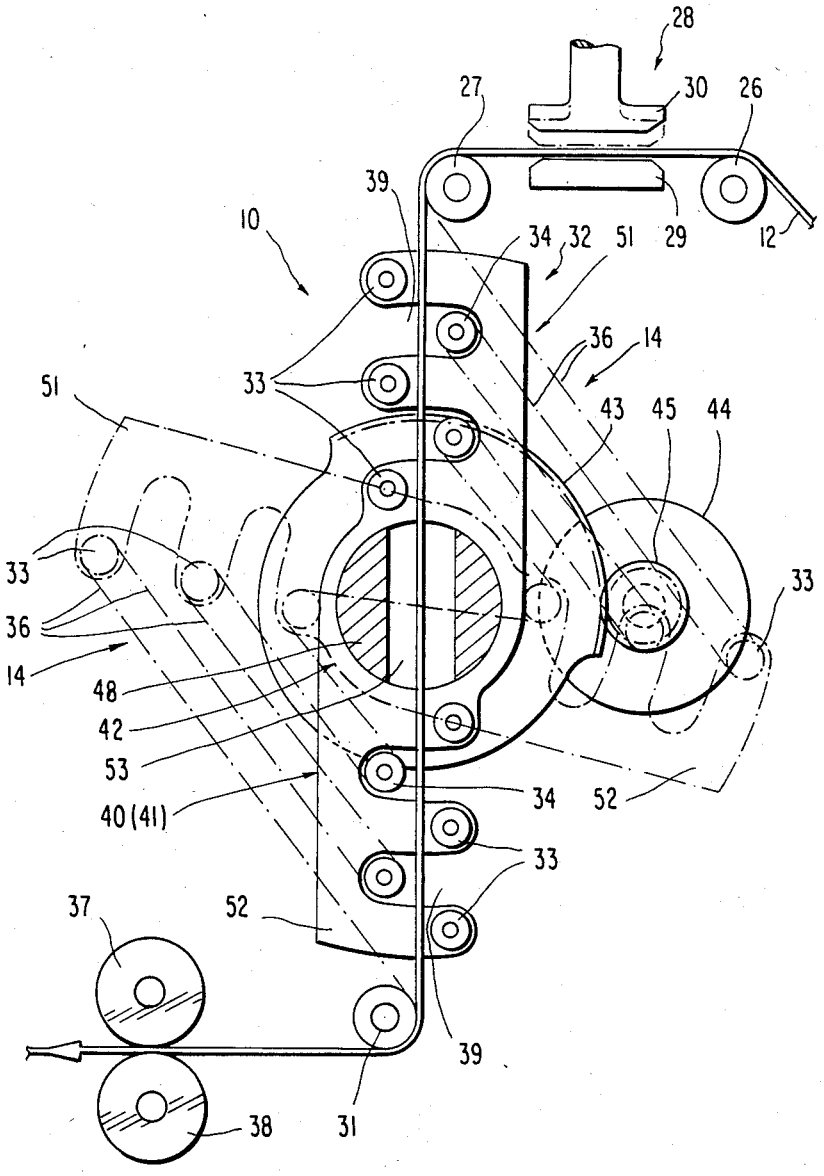
Figure 4:
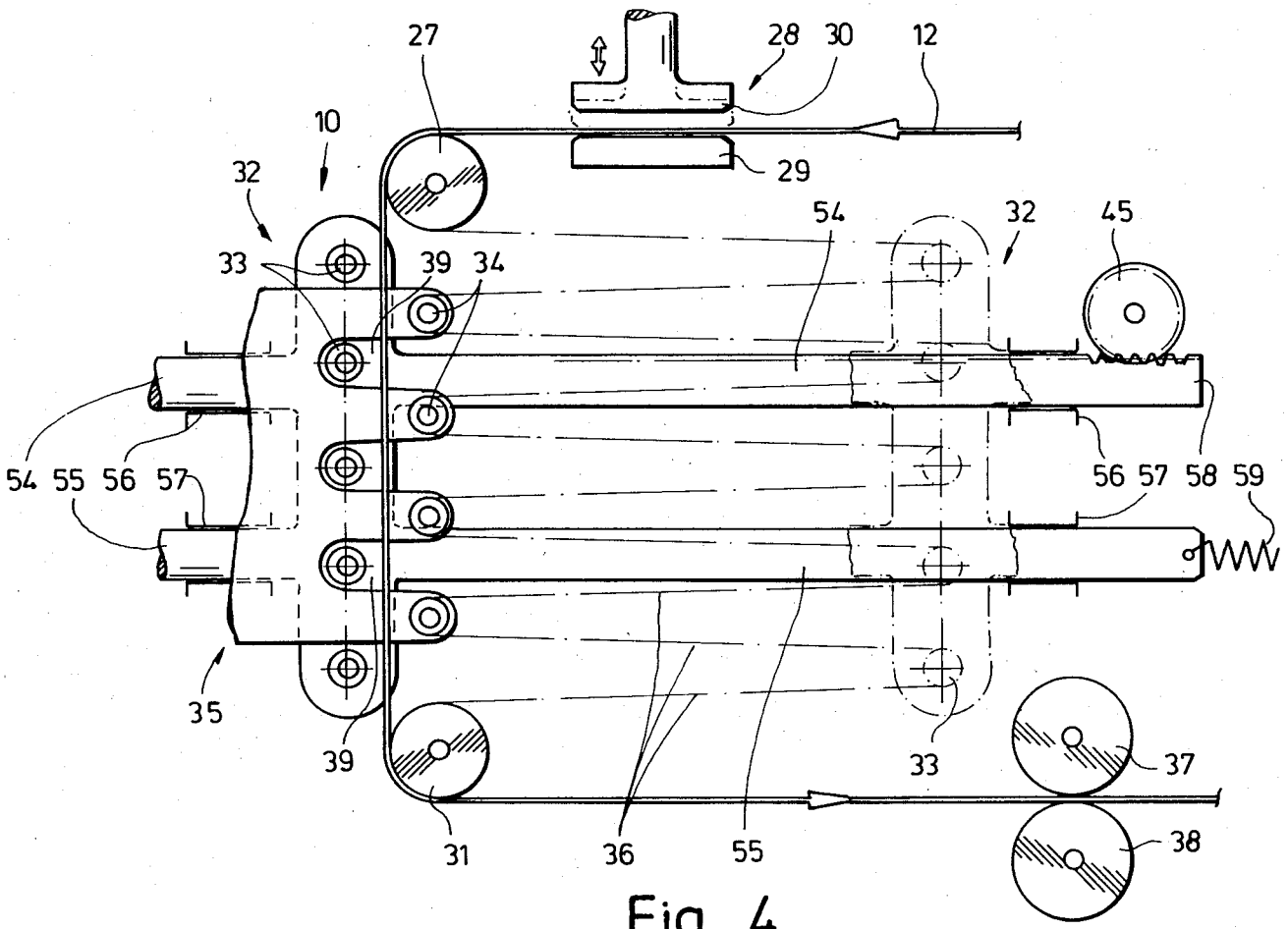

Exemplary embodiments of the invention are explained in more detail below with reference to the drawings in which:

FIG. 1 shows in a side view, a supply rocker, for example as part of a packaging machine, FIG. 2 shows, on an enlarged scale, a front view of the supply rocker, offset 90° relative to FIG. 1, FIG. 3 shows a representation, similar to that of FIG. 1, of another embodiment of the supply rocker, FIG. 4 shows, in a side view, a supply rocker with loop-forming members moveable in a straight line.

The exemplary embodiments of various supply rockers, illustrated in the drawings, are preferably assigned to a packaging machine for the purpose of (temporarily) building up a stock which consists of a plurality of sheet loops and which is reduced during a momentary standstill of the sheet in the region preceding the sheet stock, so that the sheet of material running off or transported further can be conveyed uninterruptedly.

In the exemplary embodiment of FIG. 1, a supply rocker 10 is shown, in conjunction with a splicing device 11 for joining one end of a sheet of material 12 running off to the start of a sheet of material 13 running off subsequently. In order to join the ends of the two sheets of material 12 and 13, it is necessary to stop them momentarily. However, so that a following packaging machine can continue to run without any interruption in the delivery of the sheet of material 12, before the latter is stopped a sheet stock 14 is formed, and this is reduced during the standstill because of the part of the sheet of materail 12 which is conveyed further. In this case, the sheet of material 12 is packaging material, for example plastic film or tin foil.

In the present case, the splicing device 11 consists of two pivotably mounted pressure jaws 15 and 16. Their jaw surfaces 17 and 18 are subjected to suction air via suction bores 19 in order to hold the sheet of material 12 and 13 respectively. The outer free edges 20 and 21 of the pressure jaws 15 and 16 are designed as severing knives. During the pivoting movements of the pressure jaws 15 and 16, they each interact with a fixed counter-knife 22 arranged centrally. As a result of the relative movement of a particular pressure jaw out of the end position shown until it comes up against the opposite jaw, at the same time taking the sheet of material along with it, the latter is severed when it moves past the counter-knife 22. In the position shown, the pressure jaw 16 together with the running-off sheet of material 12 is moved until it comes up against the pressure jaw 15. The free end of the sheet of material 12 thereby formed is joined by means of an adhesive strip 23 to the end of the sheet of material 12 pressed on. The sheet of material 13 is now fed into the production run as the "active" sheet of material running off. As soon as an associated reel (not shown) is used up, the operation of joining the ends of the sheets of material 12 and 13 is carried out in the opposite direction. For this purpose, the angular pressure jaws 15 and 16 are actuated alternately by means of connecting rods 24, 25.

The particular sheet of material 12 running off is conveyed into the region of two deflecting rollers 26 and 27 which, in the present case, lie in the same horizontal plane. Located in the region between these is a sheet clamp 28 consisting of a (lower) fixed clamping jaw 29 and an (upper) second clamping jaw 30 moveable up and down. The sheet of material 12 is clamped between these and thus fixed during the splicing operation described above.

After the deflecting roller 27, the sheet of material 12 passes into the region of the supply rocker 10 arranged underneath this deflecting roller 27. The vertical region here for forming the sheet stock 14 is defined by the upper deflecting roller 27 and a further deflecting roller 31 located at a distance under it. The sheet stock 14 is formed between the deflecting rollers 27 and 31.

In the exemplary embodiment of FIG. 1, the supply rocker 10 consists of a looping-roller carrier 32 with a plurality (four) of looping rollers 33. These interact with a corresponding number (three) of counter rollers 34 attached to a fixed counter roller carrier 35. The looping rollers 33 and counter rollers 34 are arranged at a distance from one another, in such a way that the looping rollers 33 can be moved past the counter rollers 34 or can each be moved through between two counter rollers 34. A particular feature of the supply rocker 10 is that, in the initial position according to FIG. 4, the looping rollers 33 on the one hand and the counter rollers 34 on the other hand are located on different sides of the sheet of material 12 running in a straight line, that is to say vertically. Consequently, the latter can be conveyed through the supply rocker 10 free of deflections, the latter accordingly being in a stock-free position.

When the reel assigned to the "active" sheet of material 12 is virtually used up, a control signal is generated by a suitable, for example optical, sensing means and slowly sets the supply rocker 10 in motion, in such a way that the group of looping rollers 33 is moved by movement in a clockwise direction out of the position according to FIG. 1 into the position shown by dot-and-dash lines. The looping rollers 33 thereby pass through the (vertical) plane of the sheet of material 12 in the region between the deflecting rollers 27 and 31. The sheet of material 12 is thereby taken along. During the further joint movement of the looping rollers 33, in the region of the fixed counter rollers 34 the particular sheet of material 12 is wrapped around the latter to form a loop. The looping rollers 33 and counter rollers 34 are now corresponding deflecting rollers for the sheet of material 12. Sheet loops 36 of increasing size are drawn off when the looping rollers 33 move further. These loops together form the sheet stock 14. In the present case, the distance covered by the looping rollers 33 is approximately 120°.

A sheet stock 14 of sufficient size is formed before the splicing operation is started. Accordingly, when the sheet of material 12 is stopped in the region of the sheet clamp 28, there is no interruption in the continuous conveyance of the sheet of material 12 on the discharge side, that is to say in the region of constantly running draw rollers 37 and 38. The sheet of material 12 is now drawn by the draw rollers 37, 38 out of the sheet stock 14 which at the same time is constantly reduced, that is to say the looping roller 33 moves back towards the initial position. The splicing operation is concluded before the sheet stock 14 is used up. It must be remembered, here, that, after the (new) sheet of material 13 has been joined on, there must be a transitional phase during which the associated reel is brought to its full rotational speed and consequently the oncoming sheet of material 13 to its full conveying speed. After that, the rest of the sheet stock 14 can then be eliminated completely and the group of looping rollers 33 moved into the initial position shown in FIG. 1. The sheet of material now assumes a planar loop-free position again.

The relative positions of the looping rollers 33 on the one hand and the counter rollers 34 on the other hand are possible because, in the exemplary embodiment of FIG. 1, the looping-roller carrier is made comb-like, with slightly arcuate recesses 39 between adjacent looping rollers 33. The dimensions of the slit-shaped recesses 39 are such that they can receive a counter roller 34 in the initial position. It is thereby possible to hold the said groups of rollers on different sides of the sheet of material 12.

In this exemplary embodiment, the looping-roller carrier 32 is designed as a (two-armed) roller arm. Actually, as is evident from FIG. 2, two roller arms 40 and 41 are arranged at a distance from one another and connected to one another by means of the transversely directed looping rollers 33. The recesses 39 are formed in the two roller arms 40, 41 in the way described. The roller arms 40, 41 are mounted pivotably in a lower central pivot bearing 42. The roller arm 40 is provided with a lower toothed segment 43. A pinion 45 driven by a pivoting motor 44 acts on the latter.

In the exemplary embodiment of FIGS. 1 and 2, the counter roller carrier 35 consists of two side walls 46 and 47. These are at a greater distance from one another than the width of the looping-roller carrier 32, so that the relative movements can take place to the extent described. The sheet of material 12 runs within the region between the roller arms 40 and 41. The counter rollers 34 are mounted rotatably in the side walls 46, 47. Furthermore, an axle 48 of the pivot bearing 42 is received in the side walls 46, 47. Finally, the pivoting motor 44 is also attached to the side wall 46 facing it.

Between the roller arms 40, 41, a central deflecting roller 49 is mounted on the axle 48. This deflecting roller is therefore concentric relative to the pivot bearing 42, so that the transport of the sheet of material 12 is independent of the pivoting movements of the looping-roller carrier 32. When the looping-roller carrier 32 is in its initial position, the fixed deflecting roller 31 is likewise received in a suitable recess 50 of the roller arms 40, 41.

The exemplary embodiment of FIG. 3 is designed in a similar way to that of FIGS. 1 and 2. However, the looping-roller carrier 32 has a special design, its roller arms 40 and 41 forming two part arms 51 and 52 which extend on both sides of the central pivot bearing 42 and in the initial position are directed upwards and downwards. Each part arm 51, 52 is provided with looping rollers 33. A corresponding number of counter rollers 34 is assigned to these. During a rotation of the roller arms 40, 41 in the clockwise direction, two sheet stocks 14 are formed, specifically on sides of the pivot bearing 42 which are diametrically opposite one another. A high reserve capacity can therefore be achieved in a relatively small space.

The pivot bearing 42 is also designed in a special way here. The rotatable axle 48 is provided with a central diametrical slit-shaped passage 53. The sheet of material 12 runs through this. In the initial position (the unbroken lines in FIG. 3), the slit-shaped passage is directed vertically, so that the (loop-free) sheet of material 12 can pass through the axle 48 in a vertical plane. When the roller arms 40, 41 are pivoted, the axle 48 with the passage 53 is set obliquely or transversely in a corresponding way, so that the sheet of material 12 always runs through the passage 53 as a result of deflection by the adjacent looping rollers 33.

The construction and mode of operation of this supply rocker 10 otherwise correspond to those according to FIGS. 1 and 2.

FIG. 4 shows a solution in which a supply rocker 10 is equipped with roller carriers moveable linearly, that is to say in a straight line. The counter roller carrier 35 is arranged fixed in place in the region between the two deflecting rollers 27 and 31. The moveable looping-roller carrier 32 can move transversely relative to the sheet of material 12 to form the sheet loops 36 in the way described.

Here, the looping-roller carrier 32 and the counter roller carrier 35 each appropriately consist, in a similar way to the exemplary embodiment of FIG. 1, of two walls which are arranged at a distance from one another and which are connected to one another by means of the transversely directed rollers. Here, as a variation of the preceding exemplary embodiments, recesses 39 are formed in the counter roller carrier 35. This is therefore of comb-like design. In the initial position according to FIG. 4, the looping rollers 33 are received in these recesses 39, each offset in terms of height relative to the corresponding counter rollers 34.

The looping-roller carrier 32 or its lateral walls are provided with supporting rods 54, 55. These are supported in fixed (plain) bearings 56, 57. Racks 58, with each of which a pinion 45 is engaged, are formed as extensions of these supporting rods 54, 55.

In all the embodiments of the supply rockers 10, the looping-roller carriers 32 return to the initial position (elimination of the sheet stock 14) by means of the pivoting motor 44 driven in opposition and/or by means of a restoring spring 59, by which the looping-roller carrier 32 is always prestressed into the initial position.

We claim:

1. Apparatus for transporting sheets of material, said apparatus including means for temporarily storing at least one of said sheets of material (12), said temporary storing means comprising:

a supply rocker (10) which includes a looping roller carrier (32), a plurality of looping rollers (33) mounted on said looping roller carrier, a plurality of fixed counter rollers (34) positioned relative to said looping rollers such that said sheet of material can pass between said looping rollers and said counter rollers, and a pivot bearing (42) which includes a rotatable axle (48); and means for pivoting said looping roller carrier (32) about said pivot bearing (42) to thereby cause said looping rollers to move relative to said counter rollers to permit said sheet of material to either run in a straight line between said looping rollers situated on one side thereof and said counter rollers situated on the other side thereof or run in a looped path between said looping rollers and said counter rollers, depending on the position of said looping roller carrier;

wherein said looping roller carrier is comprised of first and second pivot arm portions (51,52) extending in opposite directions from said pivot bearing (42), each of said pivot arm portions having mounted thereon a plurality of looping rollers, associated fixed counter rollers being provided for the looping rollers of each of said first and second pivot arm portions; and wherein said rotatable axis (48) is connected to said looping roller carrier (32) to rotate therewith, and includes a slit-shaped passage (53) through which said sheet of material may pass regardless of the position of said looping roller carrier.

2. Apparatus according to claim 1 further including a pivoting motor (44) with a pinion (45), said looping roller carrier including a toothed segment (43), said pinion (45) and the segment (43) being interconnected whereby the looping roller carrier driver by said pivoting motor through said pinion and toothed segment.

3. Apparatus according to claim 1, characterised in that each pivot arm portion (51,52) includes two separated roller arms (40,41), said roller arm being made comb-like, with recesses (39).

4. Apparatus according to claim 1, characterised in that a deflecting roller (27,31) for the sheet of material (12) is arranged respectively before and after the looping rollers (33) and counter rollers (34).

5. Apparatus according to claim 4, characterised in that a further deflecting roller (26) is located in front of the deflecting roller (27) before the looping rollers and at the same height as said deflecting roller and a sheet clamp (28) for stopping the sheet of material (12) is located in the region between the further deflecting roller (26) and said deflecting roller (27).

6. Apparatus according to claim 1, characterised in that draw rollers (37,38) are arranged after the supply rocker (10) in the conveying direction of the sheet of material (12).

* * * * *